United States Patent [19]

Suzuki

[11] Patent Number: 5,035,430

[45] Date of Patent: Jul. 30, 1991

[54] PUSH PIN PUZZLE WITH INTERNAL LOCKING MECHANISM

[75] Inventor: Toshio Suzuki, Tokyo, Japan

[73] Assignee: Toybox Corporation, Topkyo, Japan

[21] Appl. No.: 462,596

[22] Filed: Jan. 9, 1990

[30] Foreign Application Priority Data

Mar. 27, 1989 [JP] Japan ..... 1-34429[U]

[51] Int. Cl.[5] ..... A63F 9/08

[52] U.S. Cl. ..... 273/153 S; 273/153 R; 70/289

[58] Field of Search ..... 273/153 P, 153 R, 156, 273/157 R, 138 R, 139, 1 R; 70/287, 288, 289, 292; 200/5 C, 5 D

[56] References Cited

U.S. PATENT DOCUMENTS

| | | | |
|---|---|---|---|
| 454,972 | 6/1891 | Lord | 273/138 R |
| 2,266,182 | 12/1941 | Ewald et al. | 70/287 |
| 2,905,474 | 9/1959 | Jahr | 273/153 R |
| 3,187,528 | 6/1965 | Check | 70/288 |

*Primary Examiner*—Edward M. Coven
*Assistant Examiner*—William M. Pierce
*Attorney, Agent, or Firm*—Staas & Halsey

[57] ABSTRACT

A puzzle toy includes a plurality of projections which normally project outwardly from a spherical body. As the projections are pushed inwardly, individually one at a time, a latching mechanism disposed within the body holds the projections in a pushed-inwardly state, assuming proper alignment of the latching mechanism. However, as each projection is pushed inwardly, the latching mechanism is rotated to vary the alignment and thus increase the difficulty of latching all of the projections.

20 Claims, 5 Drawing Sheets

PUSH PIN PUZZLE WITH INTERNAL LOCKING MECHANISM

BACKGROUND OF THE INVENTION

1. Field of the Invention

The present invention relates generally to amusement devices and toys and, more specifically, to a puzzle toy having a set of projections which are pushed inwardly by a player.

2. Description of the Related Art

Various puzzle toys have been known in which the object is to manipulate pieces of a puzzle to unify a certain color in each surface by rotating members which collectively form surfaces of a polyhedron.

Usually, in toys or puzzles which require manipulation of pieces in a predetermined order, once the puzzle is solved, it is possible for a player to memorize the sequence and thus the game looses its entertainment value.

SUMMARY OF THE INVENTION

An object of the present invention is to provide a puzzle toy in which a plurality of projections are pushed into a base body in a random order, and then, after all of the projections are released from the body by operating a reset button, the order is changed.

Another object of the present invention is to provide a puzzle toy which is relatively easy to manipulate and mechanically strong.

These and other objects are met by providing a puzzle toy which includes a body having a plurality of openings, a plurality of projections normally spring biased to extend outwardly from corresponding openings, a plurality of detents at least one of which is associated with each projection, catch means cooperating with the detents for holding the projections individually inwardly of the body when the plurality of projections are aligned with the detents, and means for moving a catch means relative to the plurality of detents.

These and other features and advantages of the puzzle toy of the present invention will become more apparent with reference to the following detailed description and drawings.

DETAILED DESCRIPTION OF THE PREFERRED EMBODIMENTS

Referring to the Figures, the puzzle toy of the present invention has a spherically shaped body 1 which is formed by connecting two hemispheres 1*a* and 1*b* along a circular seam. The two hemispheres la and lb may be connected by any suitable means, such as adhesive applied at the circular seam and/or threaded fasteners passing through screw holes 1*c*.

Figure 2:
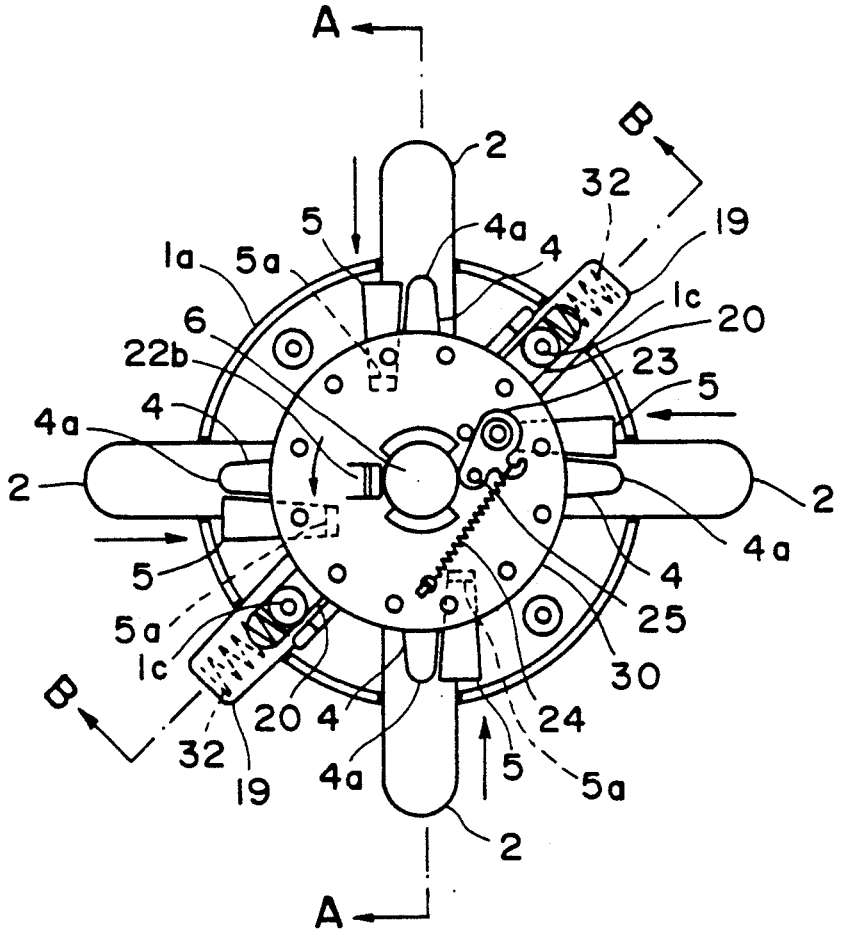
FIG. 2 is a top plan view, with a portion of the body removed, to show the interior thereof.

A plurality of openings 14 are provided in the spherical body 1, preferably with four of the holes formed with their axes at right angles to each other, and lying in a plane of the circular seam, as shown in FIG. 2. Two diametrically opposed openings 15 are provided also in the plane of the circular seam for receiving reset buttons 19. Two additional openings 16 are provided on diametrically opposed sides of the spherical body 1 on an axis substantially perpendicular to the circular plane of the seam. Projections 2 extend outwardly from the openings 14, while projections 6 extend outwardly from the openings 16.

The various projections are mounted on a unitary shaft structure which includes a plurality of shafts 31, all of which cross the center of the spherical body 1 and extend at right angles to each other. Four of these shafts mount projections 2, and have axes which lie in the plane of the circular seam.

Figure 14:
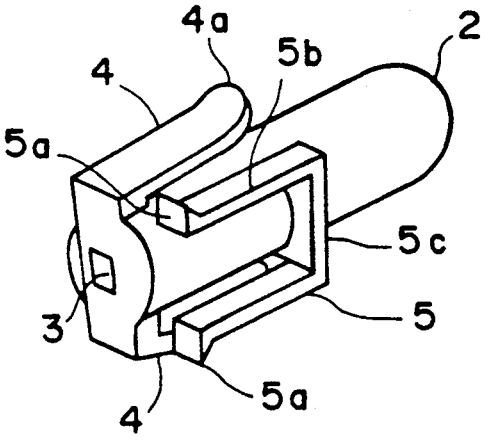
FIG. 14 is a perspective view of another one of the projections used in the FIG. 1 embodiment.
Figure 15:
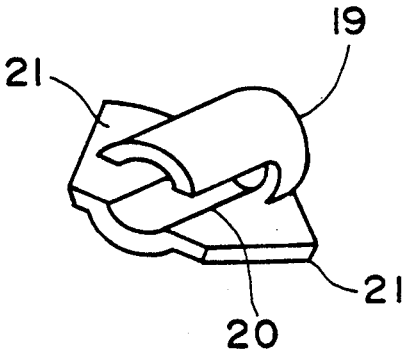
FIG. 15 is a perspective view of one of the release buttons used in the FIG. 1 embodiment.

As shown in FIG. 14, which is an enlarged view, each projection 2 has an axially disposed mounting hole 3, shaped to coincide with the shape of the mounting shaft 31, for the purpose of slidably receiving the projection. As shown in the cross-sectional views, such as FIG. 3, the projections are normally biased outwardly by a spring 18. A pair of diametrically opposed, flexible arms 4 extend axially along the outside of the projection from a base portion thereof. The distal ends 4*a* of the flexible arms 4 are angled outwardly away from the projection so as to provide a spring force when pushed inwardly. The spring force is attributable to the elasticity or flexibility of the material used to form the projections 2. Preferably, the projections are made of a molded plastic material, so as to constitute a unibody construction. The distal ends 4*a* may also be slightly wider than the proximal end portions which are integrally formed with the base.

Centered between the two flexible arms 4 is a U-shaped flexible member 5 which is mounted on the side of the projection 2. The U-shaped flexible member 5 has a pair of flexible arms 5*b* which project towards the base portion of the projection from a base 5*c* formed on the sidewall of the projection 2. The distal ends 5*a* of the arms 5*b* are shaped to abut drive projection of a rotatable plate, as will be described in greater detail below.

Figure 3:
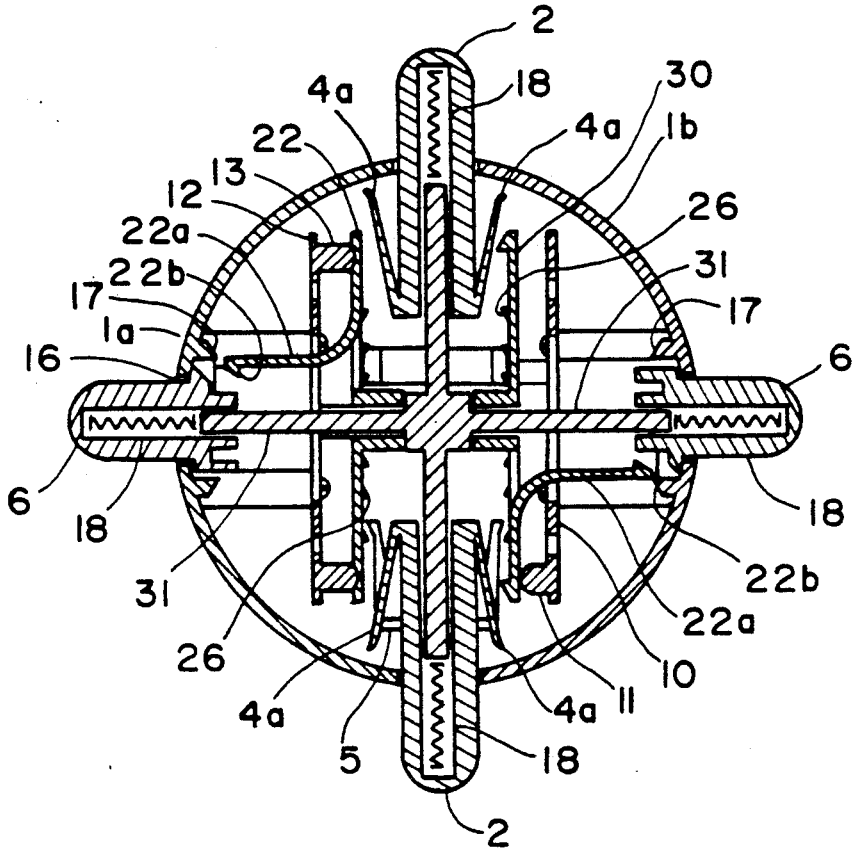
FIG. 3 is a cross-sectional view taken along line A—A of FIG. 2.
Figure 4:
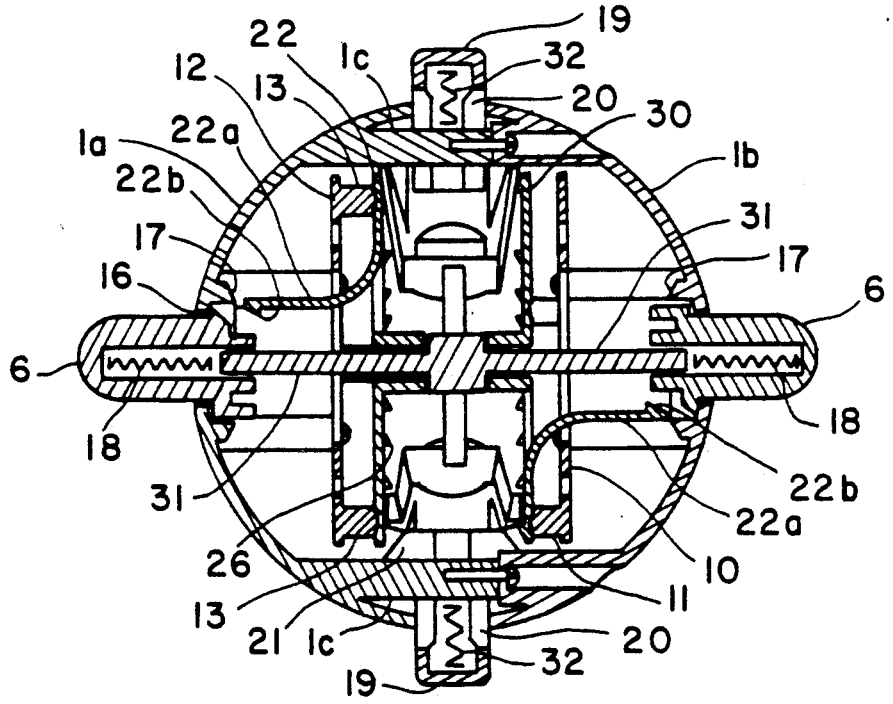
FIG. 4 is a cross-sectional view taken along line B—B of FIG. 2.
Figure 9:
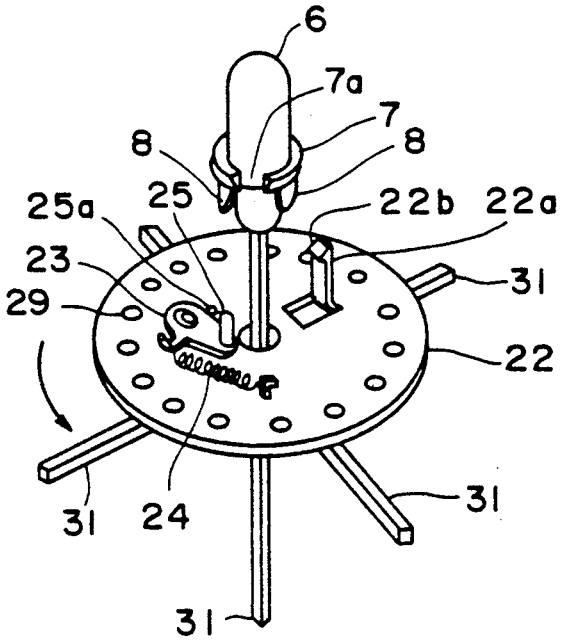
FIG. 9 is a perspective view showing a mounting structure for the projections and disks, and showing an upper surface of one of the disks.
Figure 10:
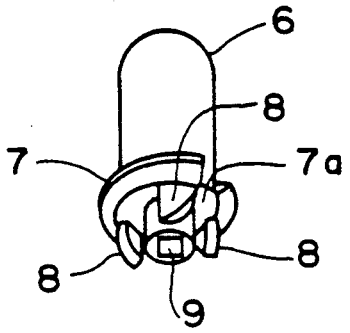
FIG. 10 is a perspective view showing one of the projections used in the FIG. 1 embodiment.
Figure 11:
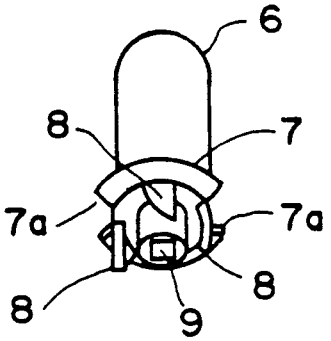
FIG. 11 is a perspective view of a projection having a slightly different shape.
Figure 12:
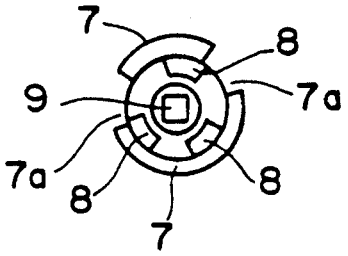
FIGS. 12 and 13 are bottom views of the projections of FIGS. 10 and 11, respectively.
Figure 13:
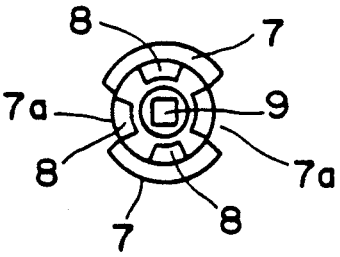

Two of the shafts 31 project coaxially to each other, and perpendicularly to the remaining shafts. These two shafts mount projections 6, as shown in FIGS. 4 and 9. As shown in FIGS. 10 through 13, each projection 6 is substantially cylindrically shaped, and is provided with a flange 7 having cut-away portion 7*a* at two angular positions of the flange at a base portion of the projection 6. A plurality of teeth 8 extend axially from the base portion of the projection 6 at substantially equidistantly spaced intervals around an axis of the projection. One side of each teeth 8 is sloped to provide a sliding, cam surface, which engages a pin of a rotatable plate, as will be explained in greater detail below. One of the projections 6 has three teeth 8, while the other projection 6 (shown in FIGS. 11 and 13) has four teeth 8. In a manner similar to the projections 2, each of the projections 6 is provided with a mounting hole 9 having a shape corresponding to the shape of the mounting shafts, which is preferably square. As shown in FIGS. 3 and 4, springs 18 are also provided for the projections 6 to spring bias the projections outwardly from their respective mounting holes 16.

Figure 5:
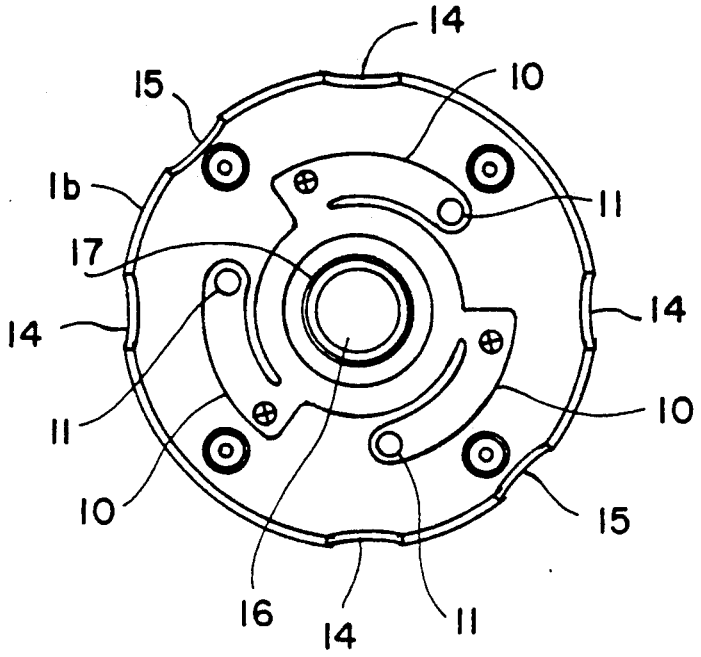
FIG. 5 is a plan view showing an interior of one-half of the body of the FIG. 1 embodiment.
Figure 6:
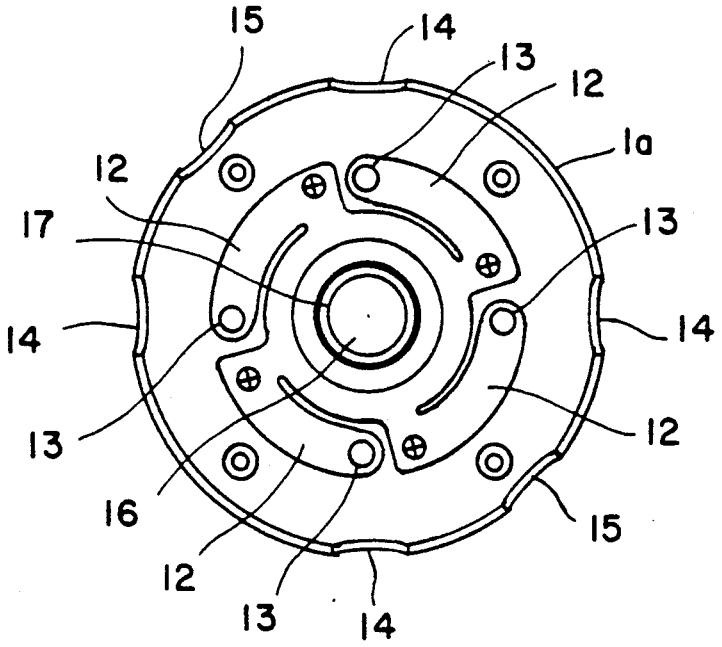
FIG. 6 is a plan view of the opposite half of the body of the FIG. 1 embodiment.

As shown in FIGS. 3 and 4, a pair of rotatable plates 22 and 30 are rotatably mounted on the shafts 31 which support the projections 6. The rotatable plate 22 presses against the projections 13 of a spring plate 12 (better illustrated in FIG. 6) which is fixedly mounted in one of the hemispheres 1a. Similarly, the rotatable plate 30 presses against the projections 11 of the spring plate 10 (shown in FIG. 5) provided in the hemisphere **1*b*. The rotation plates 22 and 30 are substantially parallel to each other, and define a space therebetween in which four projections 2** move when the projections are pushed inwardly to be latched and unlatched in a manner to be described below.

Figure 7:
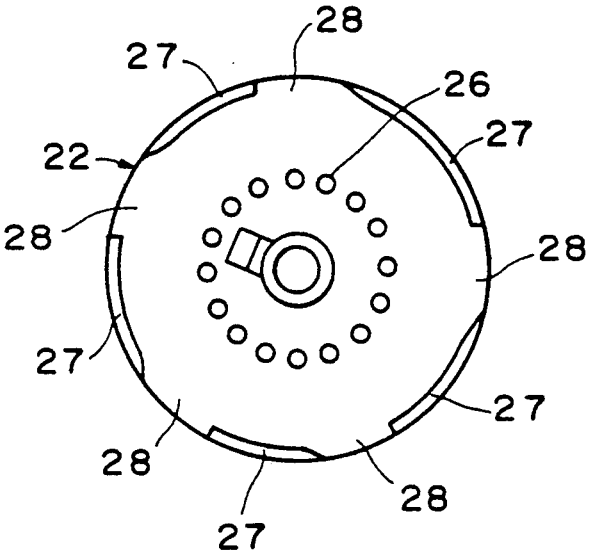
FIG. 7 is a plan view of one of two rotatable disks housed within the body of the FIG. 1 embodiment.
Figure 8:
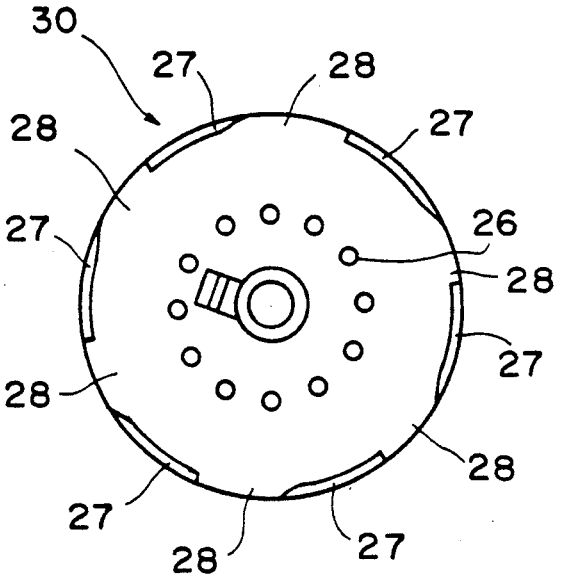
FIG. 8 is a plan view of the other of the two rotatable disks housed in the body.

As shown in FIGS. 7 and 8, the sides of the rotatable plates 22 and 30 which oppose each other have a plurality of radially disposed projections 26, each of which has a cylindrical sidewall extending upwardly from the surface of the corresponding rotatable plate, and a sloped upper end face which extends from the upper extent of the cylindrical sidewall to almost the lower extent, thus forming a shoulder which is always oriented towards the hooked ends **5*a* of the arms 5*b* of the U-shaped flexible member 5 of the projections 2. Referring to FIGS. 7 and 8, the peripheral edge portion of the rotatable plates 22 and 30, on the same surface as the projections 26, are provided a plurality of arcuate rim segments 27**.

The rotatable plate 22 has sixteen projections 26 and five rim segments 27. The rim segments 27 are spaced apart by spaces 28, the significance of which will be explained below. Similarly, the rotatable plate 30 has twelve projections 26 and six rim segments 27. The rim segments 27 on the rotatable plate 30 are also spaced apart by spaces 28.

On the opposite surfaces of each of the rotatable plates 22 and 30, which surfaces are pressed against the spring plates 12 and 10, respectively, a plurality of depressions 29 are formed in number corresponding to the number of projections 26 formed on the opposite surfaces of each of the corresponding rotatable plates 22 and 30. These depressions 29 engage the projections 11 and 13 provided on the spring plates. Thus, the projections 11 and 13 act as detents to releasably fix the angular position of the corresponding rotatable plates. Each of the rotatable plates is provided with an arm **22*a* which projects upwardly from the surfaces of the rotatable plates which include the depressions 29. The distal ends 22*b* of the arms 22*a* are hooked to engage the flange 7. The arms 22*a* also function to allow a rotation piece to be rotated. Thus, when the projections 6 are pushed inwardly, and the flange 7 is positioned to engage the hooked distal end 22*b* of the arm 22*a*, the projection 6** will remain locked in an inwardly pushed state.

On the same surface as the arms **22*a*, a pivotally connected lever 23 is resiliently held in the position illustrated in FIG. 9 by a spring 24. A pin 25 extends upwardly from the lever 23 and is positioned to engage the teeth 8 of the projections 6. The levers 23 are rotated when the rotatable plates 22 and 30 are rotated by means of the arms 5 of the projections 2 engaging the projections 26 of the rotatable plates 22 and 30. The pins 25 are thus engaged with the teeth 8, so that the lever can pivot in a clockwise direction as viewed from FIG. 9, but is prevented from pivoting in the counterclockwise direction by means of a projecting stop 25*a* provided on the corresponding rotatable plates 22 and 30. The pins 25 permit rotation of the rotatable plates 22 and 30, while the springs 24 are used for returning the levers 23**.

Figure 1:
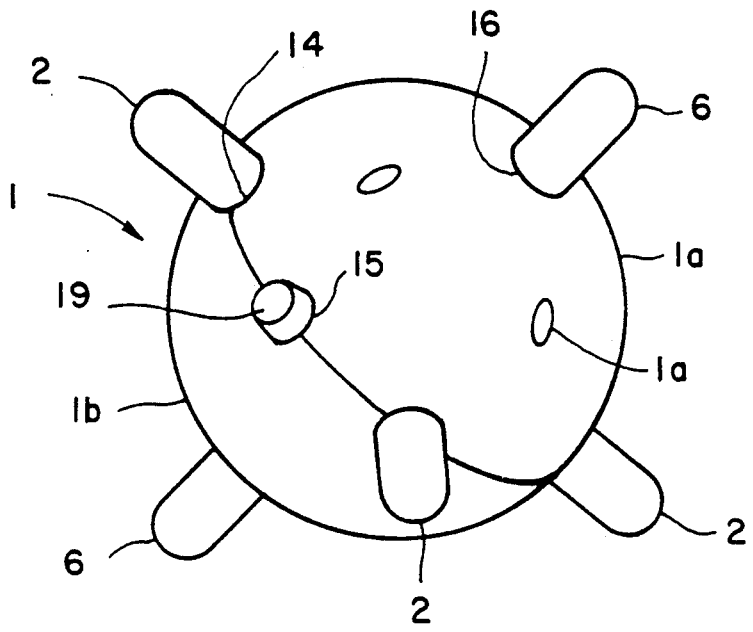
FIG. 1 is a perspective view of a first, preferred embodiment of the present invention.

The relationship between the projections 2 and 6 and the rotatable plates 22 and 30 will now be described. When all of the projections are in a position of projecting outwardly, substantially as shown in FIG. 1, the puzzle toy is in its initial, starting position. The object of the puzzle is to push all of the projections inwardly and have them stay pushed inwardly. When one of the projections 2 or 6 is pushed inwardly, the rotation plates 22 and 30 are rotated either simultaneously or separately. For example, when the projection 2 is pushed inwardly, the hooked distal end **5*a* of the flexible arms 5 provided on the projection 2 engages the projections 26 of the rotatable plates 22 and 32 to allow the rotatable plates 22 and 30 to be rotated simultaneously. When the pushing pressure to the projection is released, the projection 2 tends to spring outwardly by means of the spring 18. However, when the distal end portion 4*a* of the flexible arms 4 engage the rim segments 27 provided on the outer periphery of the rotatable plates 22 and 30, the projection 2 is held inwardly in the pushed in condition. When one of the projections 6 is pushed inwardly, the flange 7 is moved downwardly to be held by the hooked end 22*b* of the arm 22*a*. At the same time, the rotatable plate 22 or 30 (depending on which projection 6 is pushed inwardly) rotates in a certain direction, due to the sliding action of the sloped surface of the tooth 8 of the projection 6 over the pin 25, which is only occasionally positioned under one of the teeth. When the inward-pushing pressure to the projection is released, the projection is held inwardly by the hooked distal end 22 engaging the flange 7**.

When all of the projections 2 and 6 are pushed into the spherical body through corresponding holes 14 and 16, one at a time, and held in the pushed inwardly condition, the puzzle is completed. However, when the hooked distal end **4*a* of the flexible arms 4 of the projection 2 are positioned at the spaces 28 of the rotatable plates 22 and 30, the projection 2 is caused to spring outwardly by means of the spring 18 to cause the release of the distal ends 4*a* from the rim segments 27. Thus, a projection 2 may be initially depressed and held inwardly by engagement of the rim segments and spring arm distal ends 4*a*, but subsequent depression of other projections may cause the rotation plates to move to a position where one of the spaces 28 aligns with the distal ends 4*a*, thereby releasing the projection 2**.

When the hooked distal ends **22*b* of the arms 22*a* engage the flanges 7 of the projection 6, the projections are held inwardly; however, when the hooked distal ends 22*b* align with cut-away portions 7*a* by rotation of the rotatable plates 22 and 30, the projection 6 is thereby released and pushed outwardly by the spring 18. Thus, it is possible that the projections 2 and 6 pushed inwardly and initially held may become re-projected by pushing other projections. Since the number of projections 26 provided on the rotatable plates 22 and 30 are different, the angular extent of rotation of the rotatable plates 22 and 30 rotating in accordance with the pushing of the projections 2 becomes different. Thus, while both rotatable plates are designed to rotate with each inward depression of a projection, the amount of rotation varies between the two. The plate with the larger number of projections will rotate through a smaller angle of movement than the other rotatable plates. This timing difference adds to the randomness at which the depression of one projection affects the ability of the other projections to stay in a depressed state. Also, the length of the rim segments 27 provided on the outer periphery of the rotatable plates 23 and 30 are randomly selected so as to further increase the randomness at which the projections affect each other. This feature is manifest in the spaces 28** having a varying width.

The object of the game is to push all of the projections inwardly and have them all held in the inward position. The projection are pushed individually, one at a time, until all of the projections are held. With six projections, the minimum number of "pushes" will be six; however, because of the aforestated inter-dependence of the projections, it is likely during play by a player that a previously depressed and held projection will be re-projected by movement of the rotatable plates.

After the puzzle has been completed, it will become necessary to release all of the projections. For this purpose, a pair of this reset buttons 19 are provided to project through holes 15. As shown in FIG. 4, the reset buttons 19 have a groove 20 which is formed in the longitudinal direction. One end of the groove 20 is open. The outer periphery of each reset button 19 is provided with a wedge 21 which angle inwardly towards the inward end of the reset buttons 19. As shown in FIG. 2, bosses 1*c* are used in conjunction with springs 32 in the grooves 20 to provide an outward bias of the reset buttons.

As shown in FIG. 4, the wedges 21 engage opposing inner surfaces of the rotatable plates 22 and 30. When all of the projections 2 and 6 are pushed and held inwardly, the rotatable plates 22 and 30 are moved in opposite directions by the wedges 21, which separate the rotatable plates when the reset buttons 19 are pushed simultaneously. When the rotatable plates are thusly separated, the engagement between the projections 2 and the rim segments 27 is released. Then, the projections 2 are pushed outwardly by the springs 18. Also, the hooked distal ends 22*b* of the rotatable plates 22 and 30 are moved in a separating direction by engaging a collar 17 provided around the opening 16 inside the respective hemispheres 1*a* and 1*b* to release the engagement between the distal ends 22*b* and the flanges 7 of the projections 6. Thus, the projections 6 are re-projected by the force of the springs 18.

The present invention as described above is easy to play, but difficult to master because of the randomness at which the depression of one projection effects the others. Thus, the puzzle toy can be enjoyed by players of all ages and abilities.

Numerous modifications and adaptations of the present invention will be apparent to those so skilled in the art and thus, it is intended by the following claims to cover all such modifications and adaptations which fall within the true spirit and scope of the invention.

What is claimed.

1. A puzzle toy comprising:

a body having an interior and a plurality of openings;

a plurality of projections movably mounted in corresponding openings, and projecting outwardly therefrom in a normal position;

means disposed in the interior of the body for mounting the plurality of projections;

means for latching each projection in an inwardly pushed position;

means for releasing the plurality of projections after latching all projections in the inwardly pushed position;

wherein some of the projections include at least one detent which forms part of the latching means; and wherein the latching means includes first and second rotatable plates, each having a plurality of peripherally disposed spaced apart abutments which catch the detents of the projections when moved into alignment therewith.

2. A puzzle toy according to claim 1, wherein the first and second rotatable plates include drive means, operatively coupled to the projections having detents, for rotating the first and second rotatable plates when the projections having detents are pushed inwardly.

3. A puzzle toy according to claim 2, wherein the detents are a pair of spring arms disposed on a base portion of the projections and extending upwardly therefrom and having distal end portions.

4. A puzzle toy according to claim 3, wherein the first drive means includes a plurality of radially disposed drive projections disposed on opposing surfaces of the first and second rotatable plates and a pair of drive means disposed on each projection having a pair of spring arms, and engaging the drive projections of at least one of the first and second rotatable plates.

5. A puzzle toy according to claim 4, wherein a different number of drive projections is provided on the first and second rotatable plates so that the first and second rotatable plates rotate in different angular increments.

6. A puzzle toy according to claim 4, wherein the other of the projections have flange segments disposed around a periphery thereof, and each of the first and second rotatable disks includes a detent engaging the corresponding flange segments when aligned therewith and when the flanged projections are depressed.

7. A puzzle toy according to claim 6, further comprising second drive means associated with the flanged projections for intermittently rotating the corresponding one of the first and second rotatable plates when the flanged projections are pushed inwardly.

8. A puzzle toy according to claim 7, wherein the second drive means includes at least two spaced apart teeth provided on each flanged projection, and engaging a pin upstanding from each rotatable plate.

9. A puzzle toy according to claim 13, wherein each pin is mounted on a lever for pivotal movement in one direction, and includes a spring return.

10. A puzzle toy according to claim 1, wherein the other of the projections have flange segments disposed around a periphery thereof, and each of the first and second rotatable plates includes a detent engaging the corresponding flange segments when aligned therewith and when the flanged projections are depressed.

11. A puzzle toy according to claim 1, wherein the releasing means comprises a pair of release buttons, each having a wedge and being movable between the first and second rotatable plates to drive the first and second rotatable plates in opposite directions, thus releasing simultaneously the plurality of projections.

12. A puzzle toy according to claim 1, wherein the mounting means comprises a plurality of shaft segments all of which converge at a center of the body at right angles to each other.

13. A puzzle toy according to claim 1, wherein the body is a hollow sphere.

14. A puzzle toy according to claim 1, further comprising first and second spring plates fixedly connected to the body on the interior thereof and biasing the corresponding first and second spring plates toward each other.

15. A puzzle toy according to claim 14, wherein each of the first and second spring plates include a plurality of radially disposed protrusions which fit into corresponding depressions formed on surfaces of the first and second rotatable plates which oppose the first and second spring plates.

16. A puzzle toy comprising:

a body having an interior and a plurality of openings;

a plurality of projections movably mounted in corresponding openings, and projecting outwardly therefrom in a normal position;

means disposed in the interior of the body for mounting the plurality of projections;

means for latching each projection in an inwardly pushed position; and means for releasing the plurality of projections after latching all projections in the inwardly pushed position, wherein the mounting means comprises a plurality of shaft segments all of which converge at a center of the body at right angles to each other.

17. A puzzle toy according to claim 16, wherein some of the projections include at least one detent which forms part of the latching means.

18. A puzzle toy according to claim 17, wherein the movable means includes first and second rotatable plates, each having a plurality of peripherally disposed spaced apart rim segments which catch the detents of the projections when moved into alignment therewith.

19. A puzzle toy comprising:

a body having an interior and a plurality of openings;

a plurality of projections movably mounted in corresponding openings, and projecting outwardly therefrom in a normal position;

means disposed in the interior of the body for mounting the plurality of projections;

means for latching each projection in an inwardly pushed position; and means for releasing the plurality of projections after latching all projections in the inwardly pushed position, wherein some of the projections include at least one detent which forms part of the latching means, and wherein the latching means includes first and second rotatable plates, each having a plurality of peripherally disposed spaced apart rim segments which catch the detents of the projections when moved into alignment therewith.

20. A puzzle toy comprising:

a body having an interior and a plurality of openings;

a plurality of projections movably mounted in corresponding openings, and projecting outwardly therefrom in a normal position;

means disposed in the interior of the body for mounting the plurality of projections;

means for latching each projection in an inwardly pushed position; and means for releasing the plurality of projections after latching all projections in the inwardly pushed position, wherein the body is a hollow sphere.

* * * * *